US010995622B2

(12) United States Patent
Mugglestone

(10) Patent No.: US 10,995,622 B2
(45) Date of Patent: May 4, 2021

(54) TURBINE ASSEMBLY FOR IMPINGEMENT COOLING AND METHOD OF ASSEMBLING

(71) Applicant: Siemens Aktiengesellschaft, Munich (DE)

(72) Inventor: Jonathan Mugglestone, Brinsley (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 8 days.

(21) Appl. No.: 16/619,632

(22) PCT Filed: Jun. 14, 2018

(86) PCT No.: PCT/EP2018/065826
§ 371 (c)(1),
(2) Date: Dec. 5, 2019

(87) PCT Pub. No.: WO2019/001981
PCT Pub. Date: Jan. 3, 2019

(65) Prior Publication Data

US 2020/0157950 A1 May 21, 2020

(30) Foreign Application Priority Data

Jun. 29, 2017 (EP) ..... 17178689

(51) Int. Cl.
*F01D 5/18* (2006.01)

(52) U.S. Cl.
CPC ..... *F01D 5/188* (2013.01); *F05D 2220/30* (2013.01); *F05D 2230/60* (2013.01); *F05D 2260/201* (2013.01); *F05D 2260/221* (2013.01)

(58) Field of Classification Search
CPC ..... F01D 5/187; F01D 9/065; F01D 25/12; F01D 5/188; F01D 5/189;
(Continued)

(56) References Cited

U.S. PATENT DOCUMENTS 9,777,581 B2 * 10/2017 Nilsson ..... F01D 5/189
9,840,930 B2 * 12/2017 Lee ..... F01D 5/187
(Continued)

FOREIGN PATENT DOCUMENTS

EP 2573325 A1 3/2013
EP 2716868 A2 4/2014
(Continued)

OTHER PUBLICATIONS

International search report and written opinion dated Sep. 12, 2018, for corresponding PCT/EP2018/065826.

*Primary Examiner* — Eldon T Brockman

(57) ABSTRACT

A turbine assembly having a hollow aerofoil, an impingement tube, and an impingement tube sleeve. The sleeve has as least one impingement tube sleeve segment, the aerofoil having at its interior surface longitudinal ribs extending from a leading edge towards a trailing edge. A first impingement tube sleeve segment provides a slotted flow blocker at a surface of the first impingement tube sleeve segment, the first impingement tube sleeve segment inserted into the hollow aerofoil such that the ribs of the hollow aerofoil engage with corresponding slots of the slotted flow blocker and such that the surface of the first impingement tube sleeve segment rests on the ribs. The impingement tube is inserted into the hollow aerofoil such that the at least one impingement tube sleeve segment is arranged between the interior surface of the hollow aerofoil and an exterior surface of the impingement tube.

12 Claims, 8 Drawing Sheets

(58) Field of Classification Search
CPC ..... F05D 2260/22141; F05D 2240/126; F05D 2260/201; F05D 2260/221
See application file for complete search history.

(56) References Cited

U.S. PATENT DOCUMENTS

| | | | | |
|---|---|---|---|---|
| 2014/0093379 | A1* | 4/2014 | Tibbott | F01D 5/188 416/224 |
| 2014/0219788 | A1* | 8/2014 | Nilsson | B23P 11/02 415/175 |
| 2017/0356296 | A1* | 12/2017 | Tibbott | F01D 5/188 |

FOREIGN PATENT DOCUMENTS

| | | | |
|---|---|---|---|
| RU | 2425983 | C2 | 8/2011 |
| RU | 2439334 | C2 | 1/2012 |
| WO | 2016036367 | A1 | 3/2016 |

* cited by examiner

TURBINE ASSEMBLY FOR IMPINGEMENT COOLING AND METHOD OF ASSEMBLING

CROSS REFERENCE TO RELATED APPLICATIONS

This application is the US National Stage of International Application No. PCT/EP2018/065826 filed 14 Jun. 2018, and claims the benefit thereof. The International Application claims the benefit of European Application No. EP17178689 filed 29 Jun. 2017. All of the applications are incorporated by reference herein in their entirety.

FIELD OF THE INVENTION

The present invention relates to an aerofoil-shaped turbine assembly such as turbine rotor blades and stator vanes, and to cooling of such components. The present invention further relates to related methods for assembling.

BACKGROUND TO THE INVENTION

Modern turbines, particularly gas turbines, often operate at extremely high temperatures to allow efficient operation. The effect of temperature on the turbine blades and/or stator vanes can be detrimental to the efficient operation of the turbine as high temperatures can result in damage of the turbine component, as the rotor blades are under large centrifugal stresses and materials of the rotor blades or stator vanes are weaker at high temperature. In extreme circumstances, this could even lead to distortion and possible failure of the blade or vane. In order to overcome this risk, high temperature hollow blades or vanes may be used with incorporated cooling channels, inserts and pedestals for cooling purposes. The mentioned features are used for impingement cooling and/or convection cooling. Also film cooling may be used to protect surfaces of the blade or vane.

Internal cooling is designed to provide efficient transfer of heat from the aerofoils and the flow of cooling air within. If heat transfer efficiency improves, less cooling air is necessary to adequately cool the aerofoils. Internal cooling typically includes structures to improve heat transfer efficiency including, for example, impingement tubes or pedestals (also known as pin fins). Hence, internal cooling within turbine aerofoils typically uses a combination of e.g. impingement cooling followed by a pedestal/pin-fin cooling region. The impingement cooling may be used for the leading edge and can span along a significant proportion of the aerofoil. The pin-fin/pedestals are usually used towards the trailing edge. Pedestals link opposing sides of such aerofoils (pressure side and suction side) to improve heat transfer by increasing both the area for heat transfer and the turbulence of the cooling air flow. The improved heat transfer efficiency results in improved overall turbine engine efficiency. Moreover, proportioning and configuration of each cooling zone is often a balance of many factors such as the material temperatures, cooling flow pressure drops, cooling consumption, as wells as manufacturing and cost constraints.

Cooling requirements of different cooling regions may differ to another. Such situations can mean that in meeting the cooling requirements in one region, excessive cooling is being used in other regions, which lead to an overall lower efficiency.

A further problem can arise when there is a need to upgrade a design by introducing film cooling into an existing non-film cooled design without changing the casting. The film cooling design can be limited because of the single feed cavity making it difficult to control the cooling flows sufficiently. In which case a multiple feed cooling cavity approach would be required. Single feed cavity means in this respect that there is a single cavity in the hollow aerofoil supplied by one supply channel. Multiple feed cooling cavity instead is a design in which several individual cooling passages are incorporated in the hollow aerofoil.

One problem for all cooling design features is that limitations in manufacturing or assembly need to be considered already in the design phase of the aerofoil.

SUMMARY OF THE INVENTION

It is a first objective of the invention to provide an advantageous aerofoil-shaped turbine assembly such as a turbine rotor blade and a stator vane with which the above-mentioned shortcomings can be mitigated, and especially, a high cooling efficiency can be realized.

It is a second objective of the present invention to provide methods for assembling such aerofoil-shaped turbine assemblies by which a more aerodynamic efficient aerofoil and gas turbine component is facilitated.

The present invention seeks to mitigate these limitations and drawbacks.

This objective is achieved by the independent claims. The dependent claims describe advantageous developments and modifications of the invention.

In accordance with the invention there is provided a turbine assembly comprising a basically hollow aerofoil, an impingement tube, and an impingement tube sleeve. The impingement tube sleeve comprises at least one impingement tube sleeve segment. The hollow aerofoil has at its interior surface longitudinal ribs extending from a leading edge towards a trailing edge of the hollow aerofoil (12). A first impingement tube sleeve segment of the at least one impingement tube sleeve segment provides a slotted flow blocker at a surface of the first impingement tube sleeve segment, the first impingement tube sleeve segment being inserted into the hollow aerofoil such that the ribs of the hollow aerofoil engage with corresponding slots of the slotted flow blocker and such that the surface of the first impingement tube sleeve segment rests on the ribs. The impingement tube is inserted into the hollow aerofoil such that the at least one impingement tube sleeve segment is arranged between the interior surface of the hollow aerofoil and an exterior surface of the impingement tube.

This design is particularly useful for single feed cavities to allow dividing an overall cooling cavity into sub-cavities. The slotted flow blocker acts as a barrier for a cooling fluid flow.

This design allows to provide such barriers in a simple way.

The term "slotted flow blocker" is considered to define a blocking element for a fluid flow, in which the blocking element has gaps or slots. It is a broken flow blocker. Usually the slots would allow fluid to pass, but as the slotted flow blocker engages with corresponding ribs, the fluid flow is substantially blocked.

As the first impingement tube sleeve segment rests on the ribs, a surface of the first impingement tube sleeve segment is distant to an interior surface of the hollow aerofoil. In consequence individual cooling cavities are formed, bordered by the surface of the first impingement tube sleeve segment, the interior surface of the hollow aerofoil, two adjacent ribs, and one or two flow blockers. Such an individual cooling cavity then can be fed individually via impingement holes present in the impingement tube. The air from this cavity can then be exhausted via film cooling holes present in the aerofoil wall or can be guided to a trailing region of the aerofoil to provide further cooling in that region.

The invention is particularly advantageous as assembly of such a turbine assembly is fairly simple. In accordance with the invention the following assembling steps may be executed in the following order: (1) providing the basically hollow aerofoil; (2) inserting the first impingement tube sleeve segment into a central region of the hollow aerofoil; (3) manoeuvring the inserted first impingement tube sleeve segment into position in a direction of a corresponding wall section of the hollow aerofoil such that the ribs of the hollow aerofoil engage with corresponding slots of the slotted flow blocker of the first impingement tube sleeve segment and such that the surface of the first impingement tube sleeve segment rests on the ribs of the hollow aerofoil; (4) optionally—if more than one impingement tube sleeve segment is to be used—inserting and manoeuvring at least one further one of the at least one impingement tube sleeve segment such that a further surface of the at least one further one of the at least one impingement tube sleeve segment rests on the ribs of the hollow aerofoil; (5) inserting the impingement tube into the hollow aerofoil such that the at least one impingement tube sleeve segment is arranged between the interior surface of the hollow aerofoil and an exterior surface of the impingement tube.

In consequence of step (3) and the optional step (4), an interior surface of the wall of the aerofoil is lined with the impingement tube sleeve segments.

In consequence of step (5), the impingement tube can be slid into the impingement tube sleeve segment(s), which is already placed inside the aerofoil by step (3) and the optional step (4).

When manoeuvring at least one further one of the at least one impingement tube sleeve segment, this may include the step of pushing the at least one further one of the at least one impingement tube sleeve segment as long as it touches the previously installed first impingement tube sleeve segment. Alternatively both impingement tube sleeve segment may rest in position with being in touch to another.

The term "sleeve" is used to indicate that on the one hand that the impingement tube sleeve is a separate component than the impingement tube, which will be connected later during assembly. On the other hand "sleeve" indicates further that the impingement tube sleeve has a mating surface to a surface of the impingement tube. This is what also is called as "form fit" connection.

"Sleeve" indicates that an expanded area of the impingement tube is in immediate contact with the impingement tube sleeve. Preferably a majority of the surface of the impingement tube should be covered by the impingement tube sleeve. Nevertheless the term "sleeve" should not be interpreted that the sleeve will fully closed or encircle the full circumference of the impingement tube. The impingement tube sleeve may be open such that it may not create a complete oval but just a curved wall with open ends, advantageously with open ends at the trailing edge end of the impingement tube sleeve.

In an embodiment the ribs may extend basically in parallel to a direction extending from the leading edge to the trailing edge. Additionally or alternatively, the ribs may extend basically perpendicular to a span-wise direction of the hollow aerofoil. Therefore these ribs provide a stable basis for the inserted impingement tube sleeve. Furthermore they provide barriers to create distinct cooling cavities at different heights of the aerofoil.

Preferably between 3 and 8 ribs may be present on each wall of the aerofoil, advantageously 4 to 6. A different number may be advantageous depending on the height of the aerofoil.

Thus, with the ribs and the spaced apart surfaces of the hollow aerofoil and the impingement tube sleeve, advantageously a plurality of impingement cooling cavities may be formed between the interior surface of the hollow aerofoil and surfaces of the at least one impingement tube sleeve segment, each separated by one of the ribs. The result is a plurality of cooling cavities and/or cooling flow passages.

In an embodiment, advantageously two or more impingement tube sleeve segments may be comprised by the turbine assembly. Particularly a second impingement tube sleeve segment of the at least one impingement tube sleeve segment may provide—similar to the first impingement tube sleeve segment—a slotted flow blocker at a surface of the second impingement tube sleeve segment, the second impingement tube sleeve segment being inserted into the hollow aerofoil such that the ribs of the hollow aerofoil engage with corresponding slots of the slotted flow blocker and such that the surface of the second impingement tube sleeve segment rests on the ribs. The slotted flow blocker of the first impingement tube sleeve segment and the slotted flow blocker of the second impingement tube sleeve segment may define impingement cooling cavities for a leading edge of the aerofoil which are separated by the flow blockers from further remaining impingement cooling cavities. The latter cavities may be located at the pressure side or the suction side of the aerofoil.

The term "engage" may also be understood as a depression of a first component that fits to a projection of a second component, so that they can be connected together.

In a further embodiment the at least one impingement tube sleeve segment and the impingement tube may be joined via a form-fit connection. Preferably surfaces of the impingement tube sleeve segment and the impingement tube have corresponding surfaces so that they can be attached directly to another without gaps in between. Thus, they may be in immediate contact to another.

In another embodiment the turbine assembly is configured for impingement cooling. Particularly, the first impingement tube sleeve segment may comprise cut-outs wherein impingement cooling holes of the impingement tube are positioned in alignment of the cut-outs. In consequence, the impingement cooling holes remain unblocked by the first impingement tube sleeve segment, so that air passing the impingement cooling holes of the impingement tube can hit the interior surface of the aerofoil in form of impingement jets. So the cut-outs provide a sufficiently large opening for a region in which impingement cooling holes—or other cooling fluid passage holes—are present in the impingement tube.

In another configuration, the slotted flow blocker may be arranged as a slotted ridge—the ridge can also be called slotted profile or slotted wall structure—attached to or being part of the first impingement tube sleeve segment, particularly as folded sheet metal cut-outs of the first impingement tube sleeve segment. If the slotted ridge is part of the first impingement tube sleeve segment, this means that the first impingement tube sleeve segment is formed integrally with the ridge so that these are a single component.

In case of the option that a slotted ridge is attached to the first impingement tube sleeve segment, the slotted flow blocker may be arranged as broken seal elements attached to the first impingement tube sleeve segment, particularly configured as rope seal elements. Preferably the first impingement tube sleeve segment may comprise fasteners via which the sealing elements may be fastened. In respect of this configuration, the term "broken seal elements" may also be met if a plurality of individual seal elements are attached to the first impingement tube sleeve segment.

As the ribs advantageously extend perpendicular to the span-wise direction, the slotted flow blocker may extend substantially in span-wise direction of the first impingement tube sleeve segment.

In another embodiment, the hollow aerofoil, the impingement tube and the impingement tube sleeve may be separate components joined or connected together for the turbine assembly, the impingement tube and the impingement tube sleeve being particularly sheet metal inserts for the hollow aerofoil.

The discussed turbine assembly may be turbine blade or turbine vane, particularly a gas turbine blade or a gas turbine vane. The hollow aerofoil may be an aerofoil of such a turbine blade or a turbine vane.

The impingement tube and/or the impingement tube sleeve may extend basically completely through a span of the hollow aerofoil.

The basically hollow aerofoil may be structured by having a leading edge cooling region at a leading edge—"leading" in respect of the flow direction of a hot main fluid path into which the aerofoil erects, thus leading meaning upstream of the main fluid path—, a pedestal cooling region at a trailing edge—"trailing" meaning downstream of the main fluid path—, a suction side with a suction side wall and a pressure side with a pressure side wall, wherein the pedestal cooling region comprises at least one pedestal extending between the suction side wall and the pressure side wall.

The given features of the impingement tube and an impingement tube sleeve may be located a region towards a leading edge of the aerofoil and/or a mid region of the aerofoil. A trailing edge region may be to narrow and therefore may be provided better with pedestal cooling.

A "turbine assembly" is intended to mean an assembly provided for a turbine, like a gas turbine, wherein the assembly possesses at least an aerofoil. The turbine assembly could be a single rotor blade or guide vane, or a plurality of such blades or vanes arranged at a circumference around a rotational axis of the turbine. The turbine assembly may further comprise an outer and an inner platform arranged at opponent ends of the aerofoil(s) or a shroud and a root portion arranged at opponent ends of the aerofoil(s). In this context a "basically hollow aerofoil" means an aerofoil with a wall, wherein the wall encases at least one cavity. A structure, like a rib, rail or partition, which divides different cavities in the aerofoil from one another, does not hinder the definition of "a basically hollow aerofoil". Preferably, the aerofoil is hollow by single cavity. In the following description the basically hollow aerofoil will be also referred to as aerofoil.

A cooling region or a leading edge cooling region may be cooled by any principle feasible for a person skilled in the art, like simple convection, film cooling, impingement cooling, vortex cooling, turbulators/ribs, dimples/pimples, etc. according to the invention it will comprise structures like one or several impingement tube. Preferably, the leading edge cooling region is an impingement cooling region comprising (at least) one impingement tube. The trailing edge cooling region is embodied advantageously as a pedestal (or) pin-fin cooling region. Further, the wall of the pressure side or of the suction side is the wall facing an exterior of the turbine assembly or being in contact with the turbine gas path surrounding the turbine assembly. This wall may also have an interior surface which may be cooled by the previously mentioned cooling features.

Moreover, an insert like the impingement tube or the impingement rube sleeve segment is intended to mean a stand-alone or independently embodied or manufactured piece or part in respect to the aerofoil that may be inserted during the assembly process inside the hollow aerofoil or its cavity, respectively. Thus, in an assembled state of the turbine assembly the insert is arranged inside the hollow aerofoil or its cavity. An assembled state of the insert in the aerofoil represents a state of the turbine assembly when it is intended to work and in particular, a working state of the turbine assembly or the turbine, respectively.

The impingement tube and/or the impingement tube sleeve as inserts rest on the ribs and optionally may be held into position in the aerofoil by any means feasible for a person skilled in the art. For example, the insert might be brazed, spot welded or glued to e.g. a pedestal, a wall of the aerofoil or a platform. Moreover, the impingement tube may be positioned inside the aerofoil by press-fitting the impingement tube to the impingement tube sleeve and further into the cavity of the aerofoil. It may be also possible that the insert has an elastic property and holding itself into position due to elastic deformation and expansion.

It is further provided that the impingement tube and/or the impingement tube sleeve is embodied as a plate or a sheet metal. Thus, the insert can be very thin in profile and light in weight. A "plate" is intended to mean a structure having at least two surfaces extending in parallel to one another and/or a basically 2-dimensional structure having a width and a length being several times (more than 10 times) larger than a depth of the structure.

According to an embodiment the impingement tube and/or the impingement tube sleeve has a curved contour extending basically along a mean camber line of the hollow aerofoil. Hence, the shape of the impingement tube is matched to the shape of the aerofoil.

The turbine assembly comprises a plurality of pedestals forming a pedestal array or bank in the pedestal cooling region. The plurality of pedestals is advantageously arranged in rows or one after the other either in span-wise direction or in chord-wise direction. For example, these rows may be arranged in such a way so that they are arranged off-set towards each other. A chord-wise or stream-wise direction is the direction from the leading edge towards the trailing edge and a span-wise direction is the direction perpendicular to the chord-wise direction or the direction from the inner towards the outer platform.

A wall or a wall segment is intended to mean a region of the turbine assembly which confines at least a part of a cavity and in particular, a cavity of the aerofoil. To provide access to the hollow aerofoil or its cavity and/or to supply cooling fluid during operation the wall segment comprises at least one aperture. The aperture and the impingement tube and/or the impingement tube sleeve as inserts are matched to one another in respect to size to allow the insertion of the insert.

According to the previously introduced configurations a turbine assembly can be provided that has an increased cooling efficiency in comparison with state of the art systems. Moreover, existing aerofoil structures can be used for assembling the turbine assembly. Hence, with the use of such a turbine assembly conventional state of the art aerofoils could be used, without costly reconstruction of these aerofoils, particularly without modification of the core of the casting of the aerofoil. Consequently, an efficient turbine assembly or turbine, respectively, could advantageously be provided.

As stated above, an aperture is used for inserting the impingement tube and the impingement tube sleeve. Hence, the aperture can facilitate a double function. The phrase "manoeuvring into position" is intended to mean a process via a passive or an active mechanism acting one the insert.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

Furthermore examples have been and will be disclosed in the following sections by reference to gas turbine engines. The invention is also applicable for any type of turbomachinery, e.g. compressors or steam turbines. Furthermore the general concept can be applied even more generally to any type of machine. It can be applied to rotating parts—such as rotor blades—as well as stationary parts—such as guide vanes.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

DETAILED DESCRIPTION OF THE ILLUSTRATED EMBODIMENTS

Figure 1:
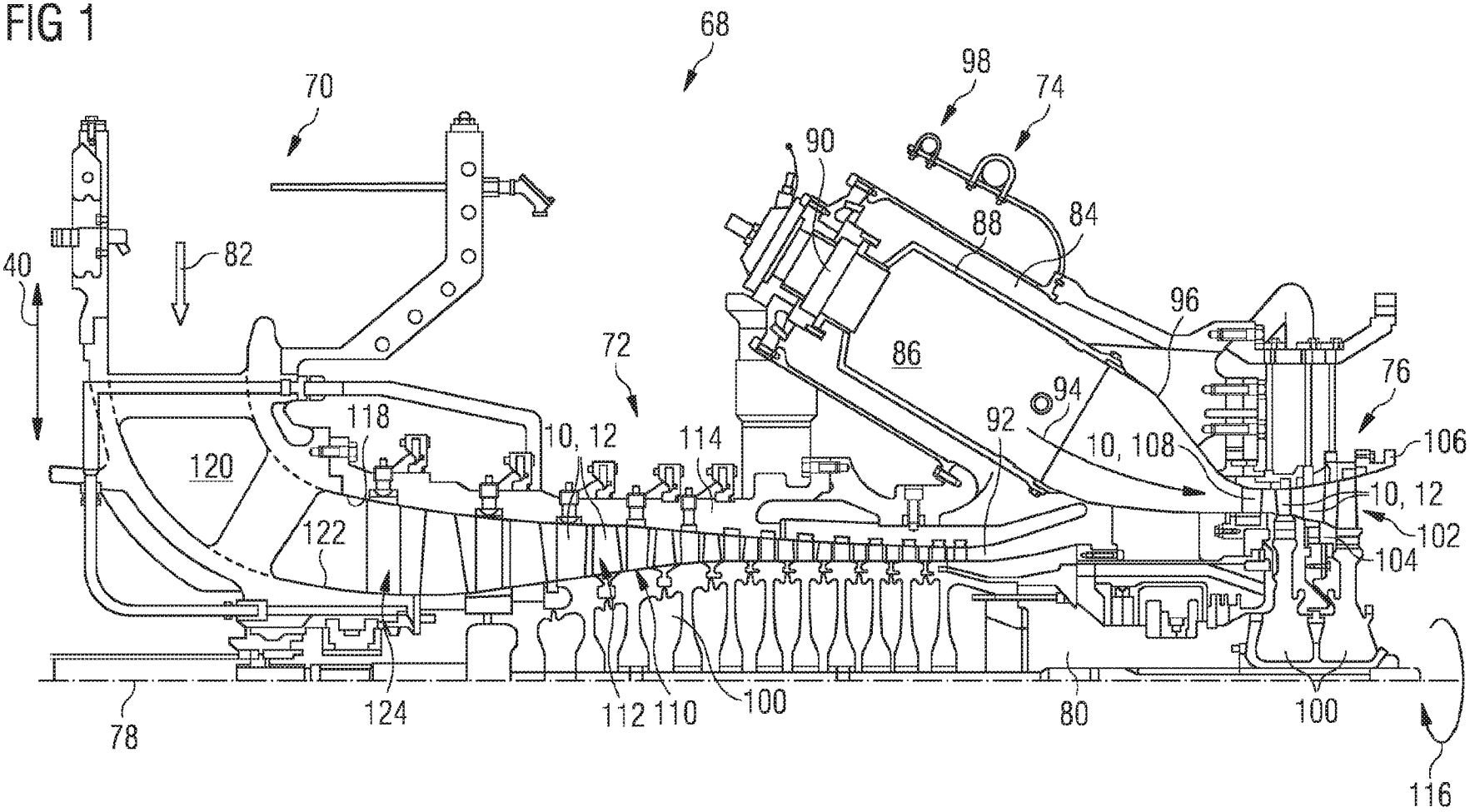
FIG. 1: shows a schematically and sectional view of a gas turbine engine comprising several inventive turbine assemblies.

The present invention is described, as shown in FIG. 1, with reference to an exemplary gas turbine engine 68 having a single shaft 80 or spool connecting a single, multi-stage compressor section 72 and a single, one or more stage turbine section 76. However, it should be appreciated that the present invention is equally applicable to two or three shaft engines and which can be used for industrial, aero or marine applications.

The terms upstream and downstream refer to the flow direction of the main or working gas flow through the engine 68 unless otherwise stated. If used, the terms axial, radial and circumferential are made with reference to a rotational axis 78 of the engine 68.

FIG. 1 shows an example of a gas turbine engine 68 in a sectional view. The gas turbine engine 68 comprises, in flow series, an inlet 70, a compressor section 72, a combustion section 74 and a turbine section 76, which are generally arranged in flow series and generally in the direction of a longitudinal or rotational axis 78. The gas turbine engine 68 further comprises a shaft 80 which is rotatable about the rotational axis 78 and which extends longitudinally through the gas turbine engine 68. The shaft 80 drivingly connects rotor components of the turbine section 76 to rotor components of the compressor section 72.

In operation of the gas turbine engine 68, air 82 which is taken in through the air inlet 70 is compressed by the compressor section 72 and delivered to the combustion section or burner section 74. The burner section 74 comprises in the shown example a burner plenum 84, one or more combustion chambers 86 defined by a double wall can 88 and at least one burner 90 fixed to each combustion chamber 86. The combustion chambers 86 and the burners 90 are located inside the burner plenum 84. The compressed air passing through the compressor section 72 enters a compressor diffuser 92 and is discharged from the diffuser 92 into the burner plenum 84 from where a portion of the air enters the burner 90 and is mixed with a gaseous or liquid fuel. The air/fuel mixture is then burned or combusted and the generated combustion gas 94 or working gas—or main fluid—from the combustion is channelled via a transition duct 96 to the turbine section 76.

This exemplary gas turbine engine 68 as depicted has a cannular—can-annular—combustor section arrangement 98, which is constituted by an annular array of combustor cans 88 each having the burner 90 and the combustion chamber 86, the transition duct 96 has a generally circular inlet that interfaces with the combustion chamber 86 and an outlet in the form of an annular segment. An annular array of transition duct outlets form an annulus for channelling the combustion gases to the turbine section 76.

The turbine section 76 comprises a number of blade carrying discs 100 or turbine wheels 102 attached to the shaft 80. In the present example, the turbine section 76 comprises two discs 100 each carry an annular array of turbine blades as turbine assemblies 10, which each comprises an aerofoil 12. However, the number of blade carrying discs 100 could be different depending on the gas turbine engine, i.e. only one disc 100 or also more than two discs 100. In addition, turbine cascades 104 are disposed between the turbine blades. Each turbine cascade 104 carries an annular array of guide vanes—which are also examples of the turbine assemblies 10—, which each comprises an aerofoil 12 in the form of guiding vanes. The guide vanes which are an element of or fixed to a stator 106 of the gas turbine engine 68. Between the exit of the combustion chamber 86 and the upstream turbine blades so called inlet guide vanes or nozzle guide vanes 108 are provided with the goal to turn the flow of working gas 94 onto the turbine blades.

The combustion gas 94 from the combustion chamber 86 enters the turbine section 76 and drives the turbine blades which in turn rotate the shaft 80 and all components connected to the shaft 80. The guide vanes 108 serve to optimize the angle of the combustion or working gas 94 on to the turbine blades. The turbine section 76 drives the compressor section 72. The compressor section 72 comprises an axial series of guide vane stages 110 and rotor blade stages 112. The rotor blade stages 112 comprise a rotor disc 100 supporting turbine assemblies 10 with an annular array of aerofoils 12 or turbine blades.

The compressor section 72 also comprises a stationary casing 114 that surrounds the rotor stages 112 in circumferential direction 116 and supports the vane stages 110. The guide vane stages 110 include an annular array of radially extending turbine assemblies 10 with aerofoils 12 embodied as vanes that are mounted to the casing 114. The vanes in the compressor section 72—like the vanes in the turbine section 76—are provided to present gas flow at an optimal angle for the blades at a given engine operational point. Some of the guide vane stages 110 may have variable vanes, where the angle of the vanes, about their own longitudinal axis, can be adjusted for angle according to air flow characteristics that can occur at different engine operations conditions.

The casing 114 defines a radially outer surface 118 of a main fluid passage 120 of the compressor section 72. A radially inner surface 122 of the passage 120 is at least partly defined by a rotor drum 124 of the rotor which is partly defined by the annular array of blades.

Figure 2:
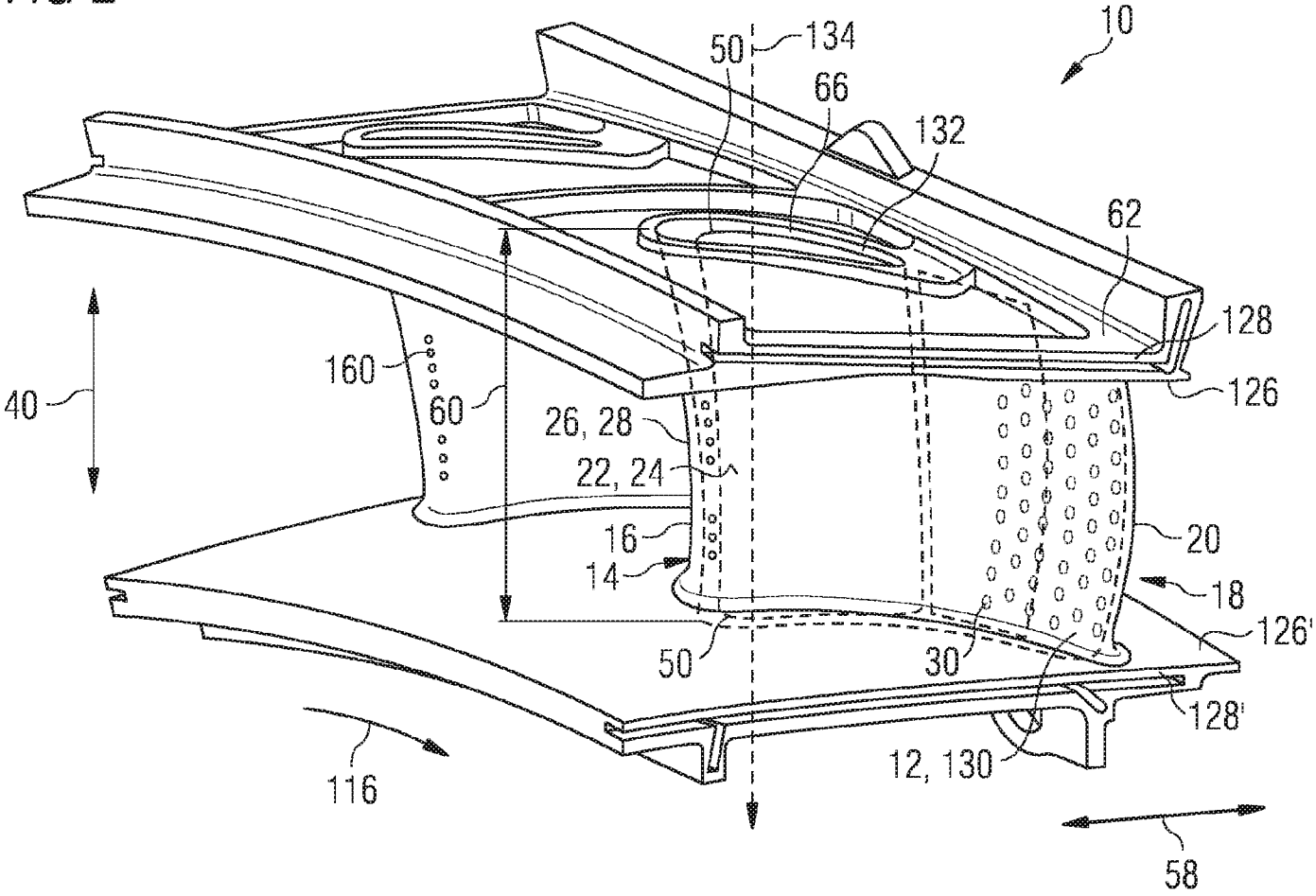
FIG. 2: shows a perspective view of a turbine assembly with an insert inserted into an aerofoil of a guide vane segment of the gas turbine engine of FIG. 1, FIG. 3: shows a cross section through the aerofoil of FIG. 2 at a medium height substantially parallel to inner or outer platforms of a prior art turbine assembly.

FIG. 2 shows a perspective view of a turbine assembly 10 embodied as a vane, of the gas turbine engine 68. The turbine assembly 10 comprises a basically hollow aerofoil 12 with two cooling regions, specifically, a leading edge cooling region 14 embodied as an impingement cooling region, and a fin-pin or pedestal cooling region 18. The former is located at a leading edge 16 and the latter at a trailing edge 20 of the aerofoil 12. At opposed ends 126, 126' the aerofoil 12 comprises an outer platform 128 and an inner platform 128'. In circumferential direction 116 of a turbine cascade 104 several aerofoils 12 could be arranged, wherein all aerofoils 12 can be connected through the inner and the outer platforms 128, 128' with one another. An overall ring of aerofoils 12 and its connected platforms 128, 128' may be assembled from guide vane segments. The shown example is a guide vane segment with two aerofoils 12.

The outer and the inner platform 128, 128' both comprise a wall segment 62 extending basically in parallel to a direction 58 extending from the leading edge 16 to the trailing edge 20 (also known as a chord-wise direction) and basically perpendicular to a span-wise direction 40 of the hollow aerofoil 12. The wall segment 62 has an aerofoil aperture 66 which is arranged in alignment with the leading edge cooling region 14 of the aerofoil 12 and provides access to the hollow aerofoil 12 (only the aerofoil aperture 66 of the wall segment 62 in the outer platform 128 is shown in FIG. 2, but an aperture may also be present in the inner platform 128').

The aerofoil 12 further comprises a suction side 26 with a suction side wall 28 and a pressure side 22 with a pressure side wall 24. Starting from the trailing edge 20 the suction side wall 28, the leading edge 14 and the pressure side wall 24 form an aerofoil boundary 130 of the hollow aerofoil 12. The aerofoil boundary 130 comprises a cavity 132 as a central region, particularly spreading over the leading edge cooling region 14 and possibly also extending to a mid region of the hollow aerofoil 12. Via the aerofoil aperture 66 a wall structure 50 represented at least by an impingement tube, can be located inside the cavity 132 for cooling purpose. The wall structure 50 extends in span-wise direction 40 completely through a span 60 of the hollow aerofoil 12. Cooling medium 134, like air, can enter the wall structure 50 through insertion aperture 66 in the outer platform 128 and a part thereof can exit the aerofoil through the insertion aperture 66 in the inner platform 128'.

In the area of the impingement tube and the impingement cooled region, advantageously near the leading edge, film cooling holes 160 may be present via which cooling air can pass through the aerofoil wall—e.g. the pressure side wall 24—to provide some film cooling effect on the hot gas washed outside surface of the aerofoil 12.

The pedestal edge cooling region 18 comprises an array of or a plurality of pedestals 30 arranged in several rows or one after the other in direction 58 from the leading edge 16 towards the trailing edge 20 as well as in span-wise direction 40. Further, the rows of pedestals 30 are advantageously arranged in both directions 40 and 58 in such a way so that they are arranged off-set towards each other.

Figure 3:
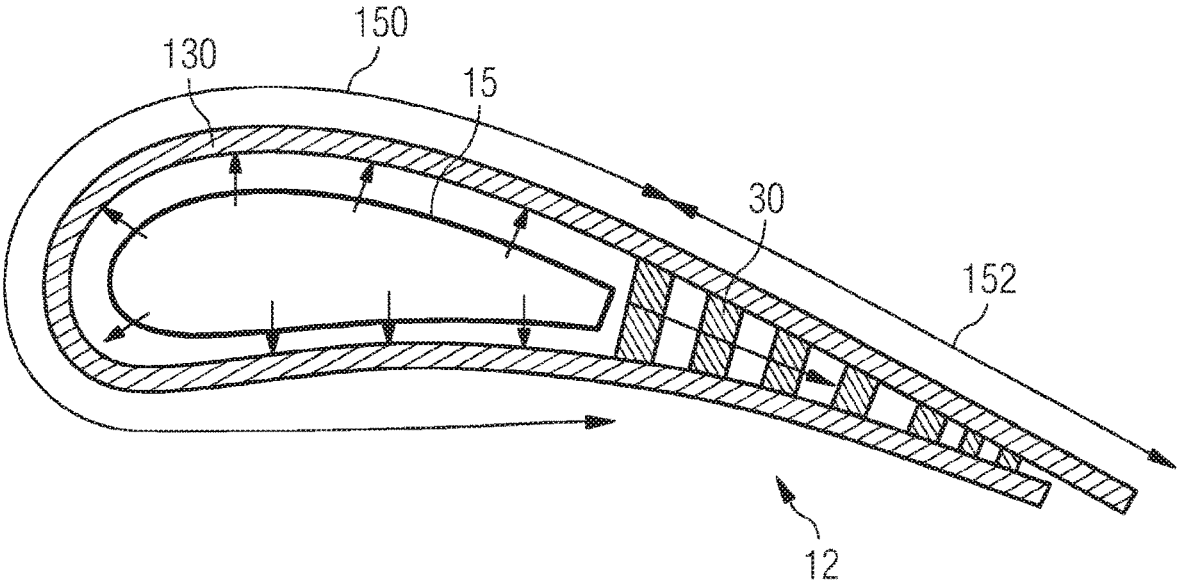

FIG. 3 shows a cross section through the aerofoil of FIG. 2 at a medium height substantially parallel to inner or outer platforms 128, 128' of a prior art turbine assembly.

The aerofoil boundary 130, the pedestals 30 and an impingement tube 15 is shown. The impingement tube 15 provides an impingement cooling region 150, the pedestals 30 provide a pedestal cooling region 152.

The impingement tube 15 comprises impingement holes, which allow to create impingement jets hitting an inner surface of the aerofoil boundary 130 during operation, as indicated by arrows in the figure.

Figure 4:
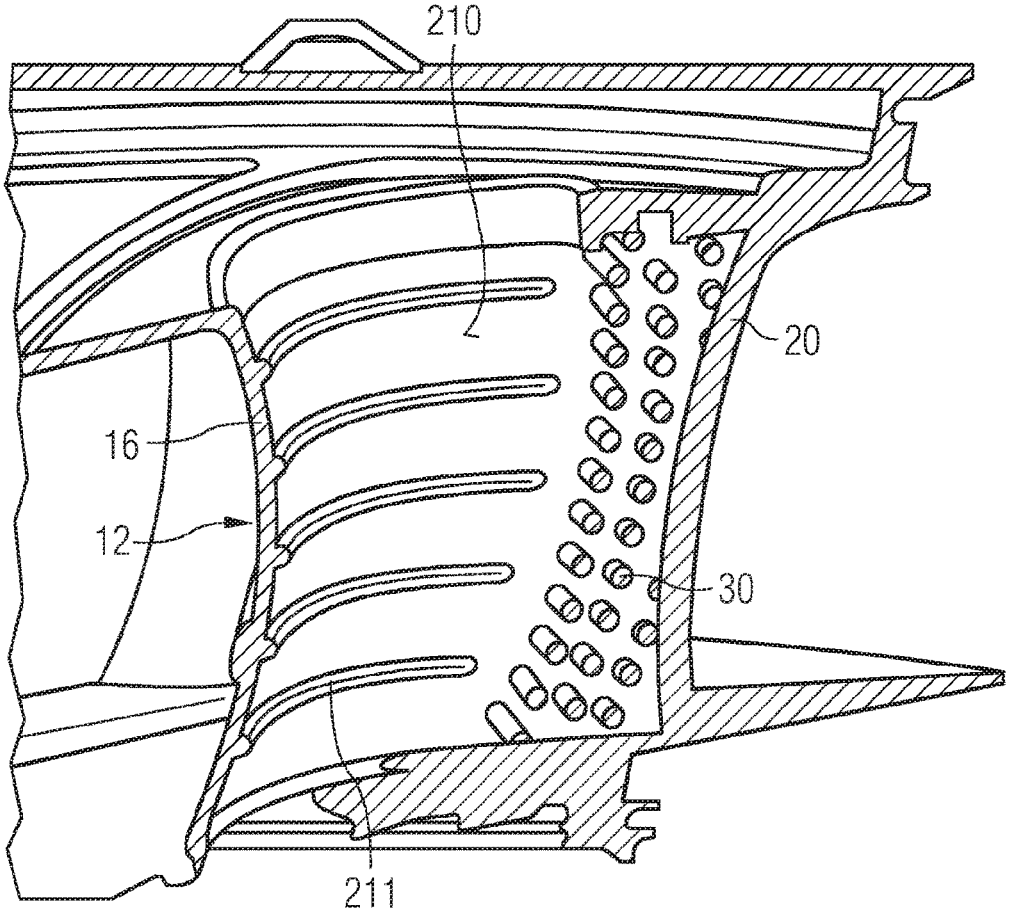
FIG. 4: shows cross section through an aerofoil from the leading edge to the trailing edge in a three-dimensional view.

The impingement tube 15 may rest on longitudinal ribs, as depicted in FIG. 4.

FIG. 4 shows a cross section through an aerofoil 12 from the leading edge 16 to the trailing edge 20 in a three-dimensional view. An impingement tube 15 is removed in this depiction. The pedestals 30 are shown, together with an interior surface 210 of the aerofoil 12 from which the pedestals 30 and longitudinal ribs 211 erect.

The ribs 211 provide a rib surface onto which the impingement tube 15 can rest once it is inserted, like in FIG. 3. Thus, a space in FIG. 3 between the impingement tube 15 and the aerofoil boundary 130 on the one hand simply shows a cavity between these two walls but on the other hand may show a top view on one of the ribs.

Figure 5:
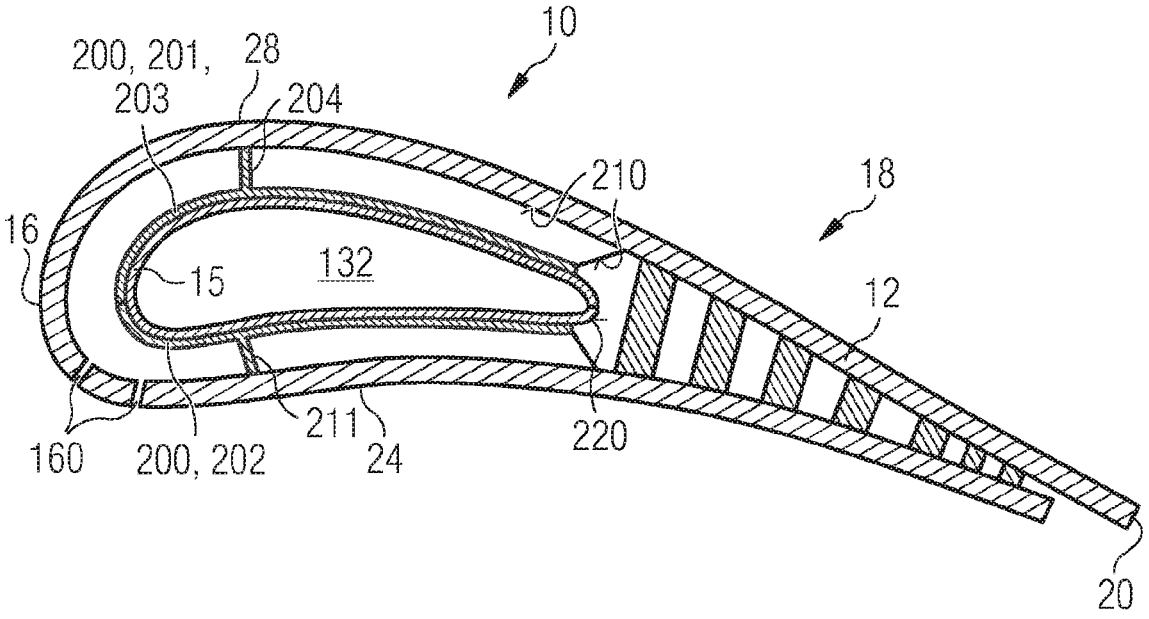
FIG. 5: shows a cross section through the aerofoil of FIG. 2 at a medium height substantially parallel to inner or outer platforms of a turbine assembly according to the invention.

FIG. 5 now shows a cross section through the aerofoil of FIG. 2 at a medium height substantially parallel to inner or outer platforms of a turbine assembly according to the invention. The inventive turbine assembly 10 is a guide vane, which is depicted in a cross sectional view.

The turbine assembly 10 is configured as a basically hollow aerofoil 12 with a pressure side wall 24 and a suction side wall 28. Similar to the configuration discussed in relation to FIG. 4, the hollow aerofoil 12 has at its interior surface 210 longitudinal ribs 211 extending from a leading edge 16 towards a trailing edge 20 of the hollow aerofoil 12. "Towards" indicates the direction but the ribs 211 already end much earlier, possibly in a mid region of the pressure side wall 24 and/or the suction side wall 28. In FIG. 5 only one of the ribs 211 is shown, which is in the plane of the cross-section or below the plane of the cross-section. The ribs 211 are particularly free of cut-outs, grooves or notches.

In the depicted configuration of FIG. 5 an impingement tube 15 is placed into a cavity 132 of the hollow aerofoil 12. The impingement tube 15 does not rest directly on the ribs 211 but an intermediate component is present in between, an impingement tube sleeve 200. The impingement tube sleeve 200 is following the shape of the impingement tube 15 so that a wall of the impingement tube sleeve 200 is in immediate and continuous, areal contact. The impingement tube sleeve 200 of FIG. 5 is segmented comprising at least one impingement tube sleeve segment 201. Shown in FIG. 5 are two segments, a first impingement tube sleeve segment 202 and a second impingement tube sleeve segment 203. In other embodiments more than two segments could be present.

In the exemplary embodiment of FIG. 5 also film cooling holes 160 are indicated, which provide a passage from an internal cavity to an exterior of the aerofoil 12, particularly to provide film cooling at the exterior of the aerofoil 12.

Figure 6:
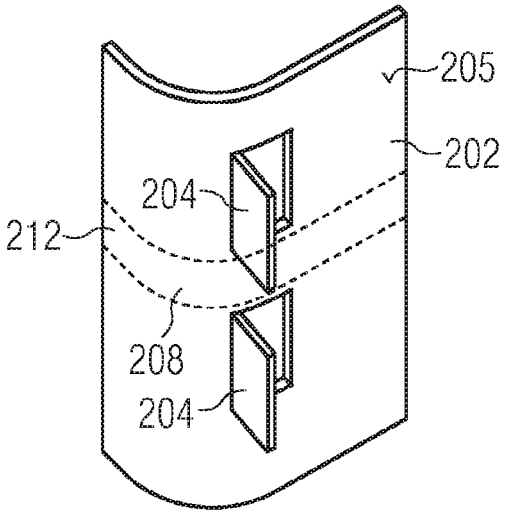
FIG. 6: shows an angled view of an impingement tube sleeve segment according to the invention.

Some of the features will now be explained by referring to FIGS. 5 to 7, by having a particular view on the first impingement tube sleeve segment 202. Nevertheless all what will be explained in relation to the first impingement tube sleeve segment 202 would also apply to the second impingement tube sleeve segment 203. FIG. 6 shows an angled view of the first impingement tube sleeve segment 202 according to the invention and FIG. 7 shows a sectional view of a section of engaging first impingement tube sleeve segment 202 with an aerofoil wall like the pressure side wall 24 according to the invention.

The first impingement tube sleeve segment 202 provides a slotted flow blocker 204 at a surface 205 of the first impingement tube sleeve segment 202. In the shown example, the slotted flow blocker 204 comprises two flaps that are arranged at an angle to the surface 205.

Figure 7:
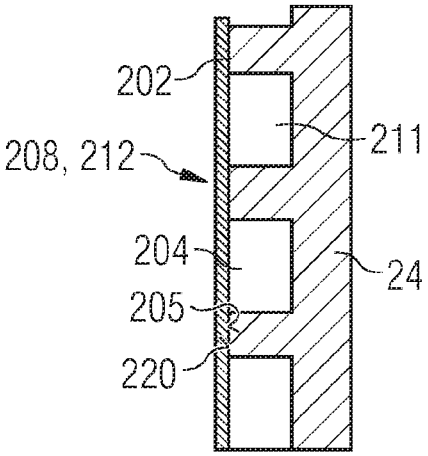
FIG. 7: shows a sectional view of a section of engaging impingement tube sleeve with aerofoil wall according to the invention.

As highlighted in FIG. 7, the first impingement tube sleeve segment 202 is inserted into the hollow aerofoil 12—particularly the pressure side wall 24—such that the ribs 211 of the hollow aerofoil 12 engage with corresponding slots 208 of the slotted flow blocker 204 and such that the surface 205 of the first impingement tube sleeve segment 202 rests on the ribs 211.

With the focus back to FIG. 5, the impingement tube 15 is then inserted into the hollow aerofoil 12 such that the impingement tube sleeve segment(s) 201 is/are arranged between the interior surface 210 of the hollow aerofoil 12 and an exterior surface 220 of the impingement tube 15. The interior surface 210 of the hollow aerofoil 12 may also be a top surface of the ribs 211. Thus, a top surface of the ribs 211 will be in contact with the first impingement tube sleeve segment 202 via a bearing surface 212, which is indicated by broken lines in FIG. 6.

In consequence, FIG. 5 show a hollow aerofoil 12 with a region with ribs 211 which is cooled via impingement cooling through the impingement tube 15. This region is located at the leading and/or mid section of the aerofoil 12. Further the aerofoil 12 comprises a pedestal cooling region 18 in a trailing region of the aerofoil 12 to use convective cooling.

In FIG. 5 two impingement tube sleeve segments 201 are indicated. How to assemble such a configuration with two impingement tube sleeve segments 201 is now shown in reference to the FIGS. 8 to 12. The same principle would also applicable for more than two of these segments.

Figure 8:
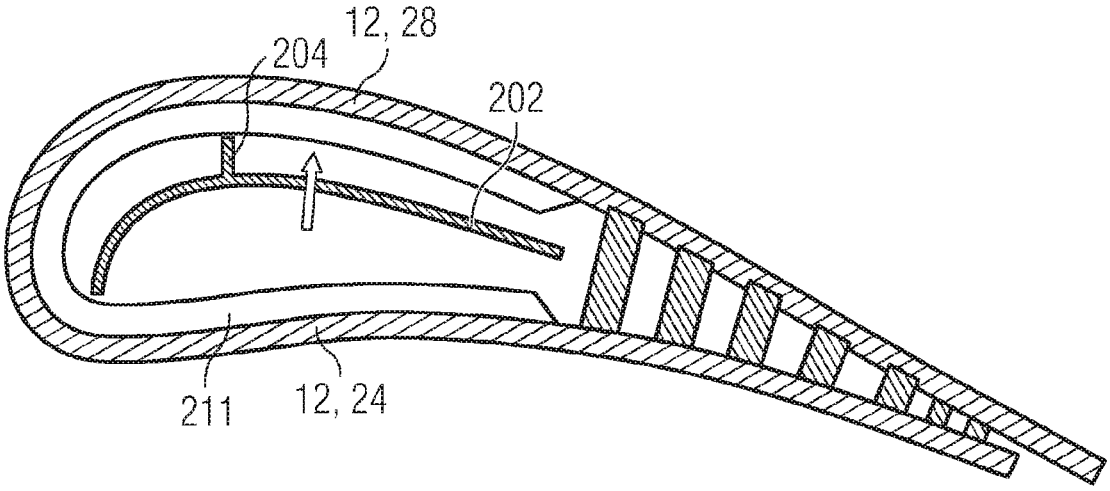
FIGS. 8 to 12: show sectional views of an aerofoil and its components at different steps of execution to illustrate a method of assembling according to the invention.
Figure 9:
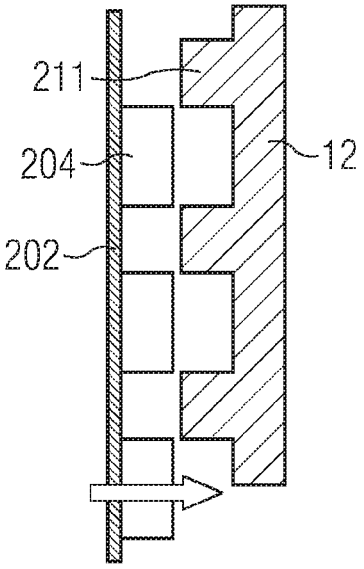
Figure 10:
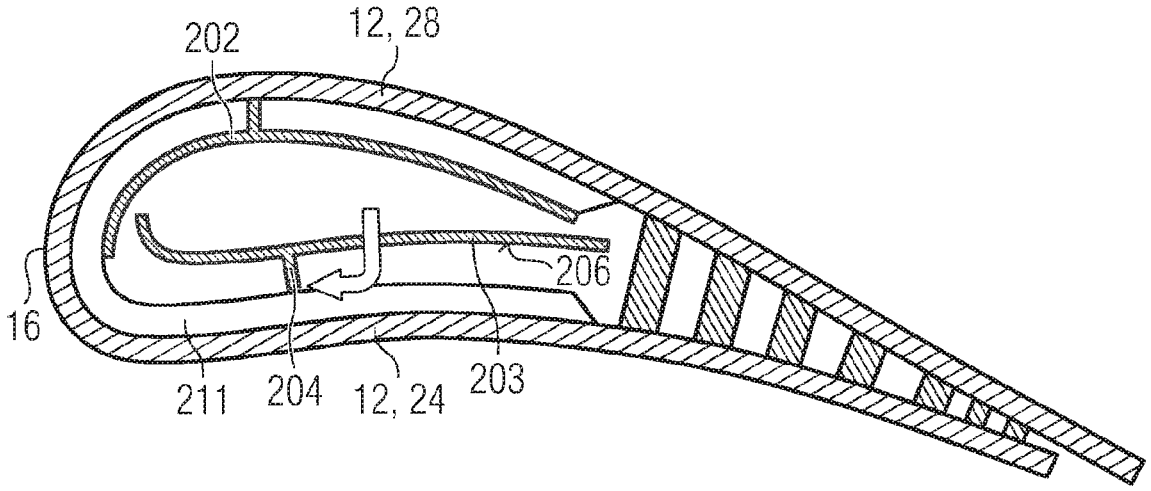
Figure 11:
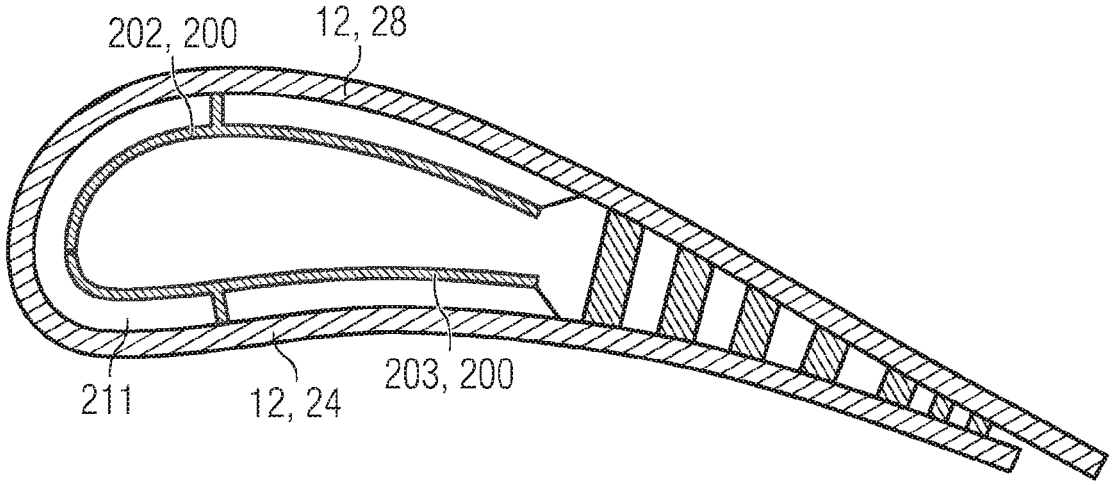
Figure 12:
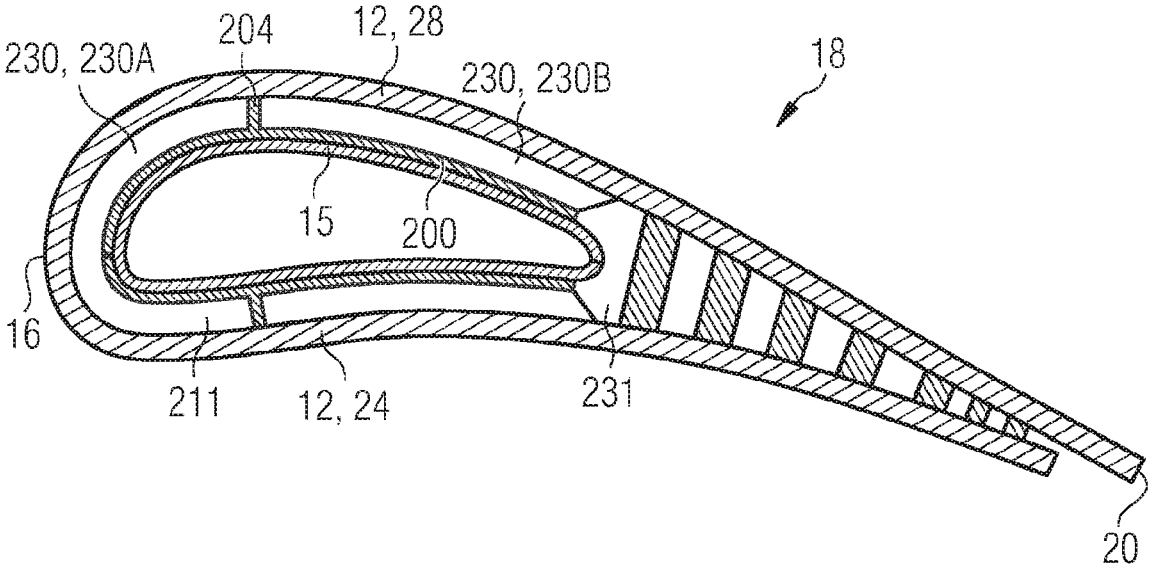

FIGS. 8 and 9 illustrate the initial step in an embodiment how to assemble an impingement tube 15 into a basically hollow aerofoil 12. FIGS. 10 to 12 show consecutive method steps for assembly this unit.

In FIG. 8 a cross sectional view of a hollow aerofoil 12 is shown, which one of a plurality of ribs 211 is shown at an interior surface 210 of the aerofoil 12. A first impingement tube sleeve segment 202 is shown as a separate component. The first impingement tube sleeve segment 202 comprises a slotted flow blocker 204 which is configured to interact with the ribs 211. The same situation is shown in FIG. 9 from a different point of view. There it can be seen that the sizes of the ribs 211 match the sizes of slots of the slotted flow blocker 204. Further, the distance between two neighbouring ribs 211 match a length of individual ones of the flow blockers 204.

Indicated by arrows in FIGS. 8 and 9, the first impingement tube sleeve segment 202 is pushed and manoeuvred into position such that the ribs 211 and the flow blockers 204 interact to another and such that the first impingement tube sleeve segment 202 will eventually be in position as indicated in FIG. 10, so that a surface 205 of the first impingement tube sleeve segment 202 rests in ridge surfaces of the ribs 211.

FIG. 10 illustrates further how a second impingement tube sleeve segment 203 is inserted into the aerofoil 12. As indicated by the arrow the second impingement tube sleeve segment 203 is pushed and manoeuvred into position such that the ribs 211 and the flow blockers 204 extending from a surface 206 of the second impingement tube sleeve segment 203 interact to another and such that the second impingement tube sleeve segment 203 will eventually form together with the first impingement tube sleeve segment 202 a common impingement tube sleeve 200, as indicated in FIG. 11. The assembling motion of the second impingement tube sleeve segment 203 may be such that initially the second impingement tube sleeve segment 203 will be moved to the adjacent side face of the aerofoil 12—here pressure side wall 24—until the ribs 211 and the slotted flow blocker 204 engage with another. Afterward the second impingement tube sleeve segment 203 is moved into direction of the leading edge 16 by sliding the engaged second impingement tube sleeve segment 203 into the direction of the leading edge 16 until all surface sections of the second impingement tube sleeve segment 203 will be in bearing contact with the ridge of the ribs 211.

After having the plurality of impingement tube sleeve segments (here: 202 and 203) in place so that an overall impingement tube sleeve 200 is created, as a final step—see FIG. 12—the impingement tube 15 can be slid into the impingement tube sleeve 200. In consequence the impingement tube 15 held in place within the aerofoil 12.

As the impingement tube sleeve 200 is supposed to have impingement holes incorporated, impingement cavities 230 are formed between a wall of the aerofoil 12, two adjacent ribs 211 and the surface or the combined impingement tube sleeve 200 and impingement tube 15. As a plurality of impingement cavities 230 can be created, cooling can be configured in a very individual way.

For example at a leading edge of the aerofoil 12, leading edge impingement cooling cavities 230A can be formed, for example with a large number of impingement cooling holes in this section.

Further impingement cooling cavities 230B can be present which are separated from the leading edge impingement cooling cavities 230A via the slotted flow blockers 204. The further impingement cooling cavities 230B may be, in an example and as shown in FIG. 12, semi-open with an opening 231 into direction of the trailing edge 20. So the further impingement cooling cavities 230B are each encapsulated by 5 walls, while a final wall is missing via which cooling fluid can be guided to the pedestal cooling region 18.

The aerofoil 12 may have—not shown—cooling holes piercing the wall of the aerofoil 12. One example would be film cooling holes near the leading edge 16, similar at it is shown in FIG. 2 by the film cooling holes 160. That means, during operation, that the leading edge impingement cooling cavities 230A would be supplied with cooling fluid via impingement holes of the impingement tube 15, which later would be exhausted through film cooling holes in the wall of the aerofoil 12. Additionally, the further impingement cooling cavities 230B would also be supplied with cooling fluid—advantageously air from a compressor of the gas turbine engine—via impingement holes present in the impingement tube 15. Cooling fluid from the further impingement cooling cavities 230B may then be exhausted via the opening 231.

The use of a sleeve that surrounds the perimeter of the impingement tube and the aerofoil aperture provides at least the following advantages. It improves the sealing at the inner and outer radius (radius of the aerofoil in respect of the rotational axis, i.e. top and bottom of the aerofoil) of the impingement tube—minimizing any leakage gaps and making it easier to join to the aerofoil, e.g. weld or braze. Further, the solution ensures that the blockage structures are all located in the correct positions, providing a datum for the outer sleeve.

The intention allows multiple cooling cavities to be created within an existing single cooling cavity design without the need to change the casting or use complex machining operations, which would lead to extremely high cost operations. The sectional formation together and assembly allow the cooling channels to be subdivided regardless of the geometric features like the longitudinal ribs on the internal surfaces of the aerofoil. The design allows improved control of the cooling flow distributions which is a critical feature when implementing higher efficiency cooling methods like film cooling into an existing non-film cooled design. The solution achieves much greater control of the flow distribution between different cooling regions which is critical for cooling design optimization i.e. controlling the flow distributions between the film cooling flows and the convection cooling regions, the latter particularly towards the trailing edge. The ability to implement optimized designs with higher aerofoil cooling efficiencies allows the cooling consumption to be reduced yielding improved engine performance, or reduced component temperatures leading to increased component life/integrity.

So far the invention can be summarized that it relates to an outer sleeve—the impingement tube sleeve 200—that locates around the impingement tube 15 that allows the cooling flow distribution in the impingement tube cooling channels to be modified by blocking or restricting the flow paths, thus helping control the distribution of cooling flows to the different regions, particularly film cooled regions. The invention uses an impingement tube assembly comprising of a standard impingement tube—element 15—together with a sectional outer sleeve, i.e. a plurality of impingement tube sleeve segments 201.

In case of an upgrade to an existing aerofoil, the impingement tube itself may similar to a previously used standard form, simply scaled to allow for the impingement tube sleeve wall thickness. The impingement tube sleeve is used to control the flow distribution in the impingement cooling channel by adding discrete flow restrictions. The impingement tube sleeve has a profile structure on the external surface that is designed to fit the cooling channel locating around the longitudinal ribs. The impingement tube sleeve is sectional to allow blockage structures to be added/assembled in-between the longitudinal ribs within the access constraints of the aperture/opening of the aerofoil. The outer sleeve is designed to be assembled first, allowing the blockages to be fitted between the ribs. The impingement tube is then pushed or slid—manually or by a machine—into position, thus securing the outer sleeve into position.

Cut-out regions may be required in the impingement tube sleeve at the corresponding locations of the impingement holes of the impingement tube 15. This will be visualized in FIG. 13.

Figure 13:
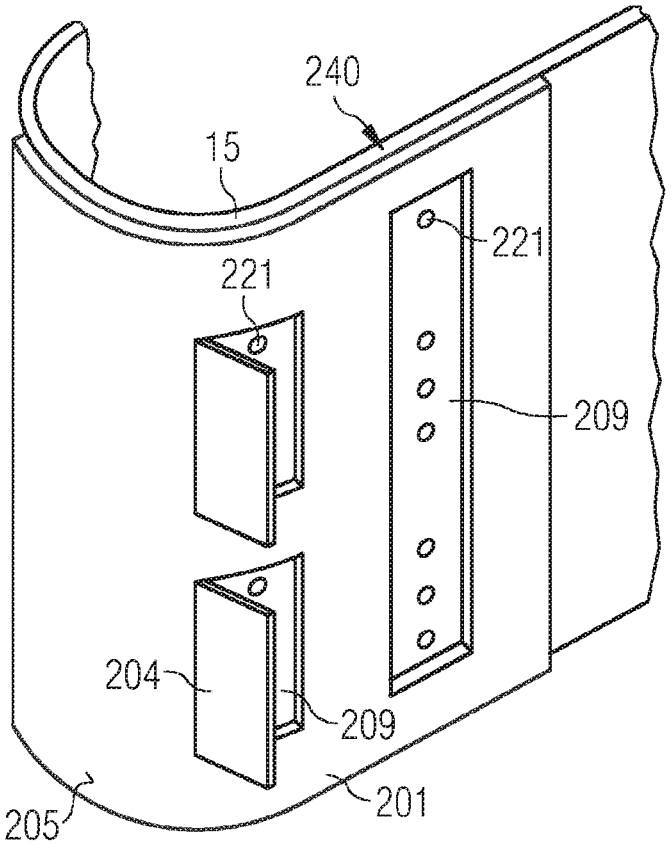
FIG. 13: illustrates an impingement tube sleeve in a three dimensional view when connected to an impingement tube.

FIG. 13 illustrates the first impingement tube sleeve 202 in a three dimensional view when connected to the impingement tube 15 wherein in FIG. 13 only a section of the impingement tube 15 is indicated. The first impingement tube sleeve 202 and the impingement tube 15 are connected by a form-fit connection 240.

"Form fit" stands for a configuration in which the first impingement tube sleeve 202 follows a surface shape of the corresponding impingement tube 15. The two components have mating and/or matching surfaces. The surfaces are interlocking with another. The surfaces may correspond to another gaplessly, as also indicated by the illustration of FIG. 13.

In FIG. 13 an exemplary slotted flow blocker 204 is shown with a plurality of blocking elements attached to the surface 205 of the impingement tube sleeve segment 201. In the example the flow blockers are arranged in a line to another.

In the example three cut-outs 209 are shown. Two of these cut-outs 209 are located directly adjacent to the segments of the flow blocker 204. One additional cut-out 209 is indicated distant to the flow blocker 204. Additional cut-outs could be present in the wall of the impingement tube sleeve segment 201.

On the wall of the adjacent impingement tube 15 a plurality of impingement cooling holes 221 are present. These holes are located on the wall of the adjacent impingement tube 15 such that they will be located in areas of the mentioned cut-outs 209. In consequence cooling fluid will be able to pass via the impingement cooling holes 221 and further pass unblocked the wall of the impingement tube sleeve segment 201, allowing an impingement effect on the interior surface 210 of aerofoil 12 (elements 210 and 12 not shown in FIG. 13 but in FIG. 5).

The impingement cooling holes 221 will be positioned advantageously such that they are located in the region of the cut-outs 209 and in regions where the impingement tube sleeve segment 201 is distant to the interior surface 210 of aerofoil 12, i.e. not in the proximity of the ribs 211 of the aerofoil 12.

Thus, the inventive design of a combination of a plurality of impingement tube sleeve segments 201 and of an impingement tube 15 allows sufficient impingement cooling of the aerofoil 12 during operation of the turbomachine.

Figure 14:
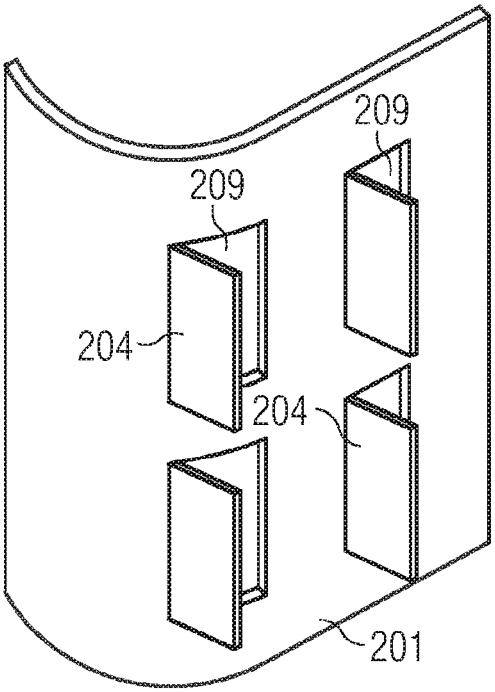
FIGS. 14 to 16: illustrate variants of impingement tube sleeves in a three dimensional view with focus on the flow blockers.
Figure 15:
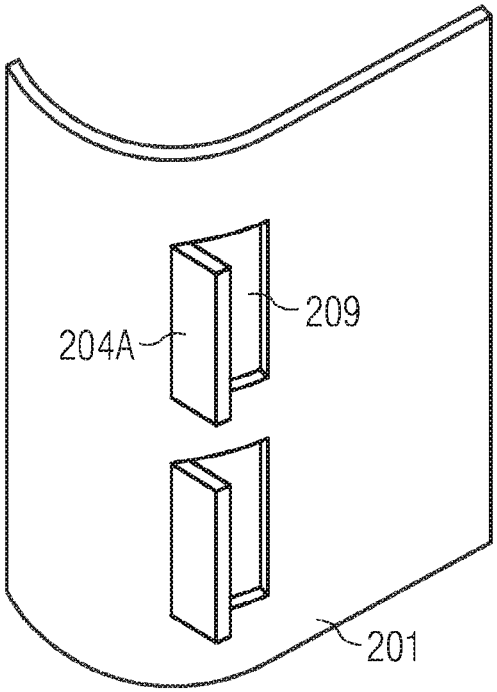
Figure 16:
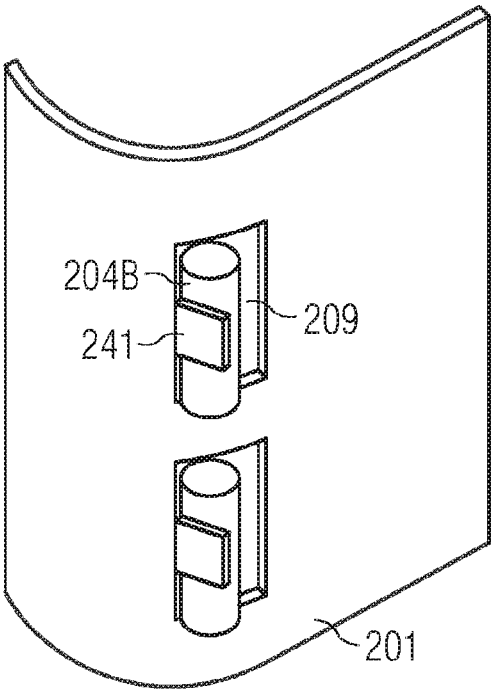
Figure 17:
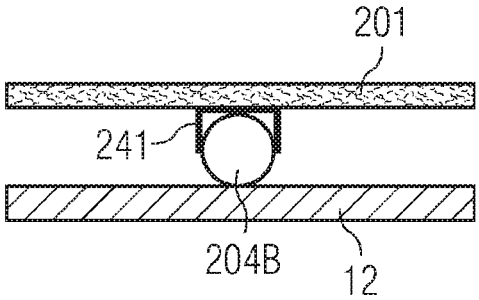
FIG. 17: illustrate a top view of the variant of FIG. 16 when installed in an aerofoil.

FIGS. 14 to 16 illustrate variants of impingement tube sleeves in a three dimensional view with focus on the flow blockers. FIG. 17 illustrate a top view of the variant of FIG. 16 when installed in the aerofoil 12.

FIG. 14 shows in an exemplary way of the already shown slotted flow blocker 204. As a variation to the already shown variant, two rows of slotted flow blockers 204 are shown, each element of the slotted flow blockers 204 with an adjacent cut-out 209.

The slotted flow blocker 204 of FIG. 14 is advantageously a thin sheet metal element. The slotted flow blocker 204 may be flexible.

FIG. 15 depicts a variant in which the slotted flow blocker is a thicker component compared to a thin sheet metal element. It could be considered as a slotted ridge 204A. It may be embodied as a cuboid. The slotted flow blocker 204A may be a rigid component.

The variant of FIG. 16, which also corresponds to the depiction in FIG. 17, shows a slotted flow blocker 204 which is configured as a broken seal element 204B. "Broken" shall indicate that the seal element is split into segments but advantageously aligned to another. As an example a rope seal can be used. For each individual segment of the broken seal element 204B a clamp 241 is attached to the surface of the impingement tube sleeve segment 201, which is configured to hold the segment of the broken seal element 204B.

A surface of the seal element 204B will then be in mating contact with an inner surface of the aerofoil 12, once installed.

It needs to be noted that in most figures only cross-sections or segments were shown. An impingement tube and/or an impingement tube sleeve may be sized as to meet the length of the span of inner cavity of the aerofoil. Alternatively the impingement tube and/or the impingement tube sleeve may only extend over a part of the span of the aerofoil.

Furthermore there are designs in which more than one impingement tube is installed inside a cavity of an aerofoil, e.g. a leading impingement tube and an impingement tube for a mid section of the aerofoil. The inventive design can also be applied to a plural impingement tube design.

All the different design options that have been explained previously allow the following operation. A pressurized cooling medium will be provided to the hollow core of the aerofoil. It will travel along the inside of the impingement tube and eventually exits through holes of the impingement tube (impingement holes), entering sub-cavities between the aerofoil wall and the impingement tube assembly—thus the impingement tube and the corresponding sleeve—and hits inner surfaces of the aerofoil wall. Preferably at a leading edge region, the cooling medium further will pass through the aerofoil wall via film cooling holes present in the aerofoil wall. Alternatively, the cooling medium further will travel through passages between the aerofoil wall and the impingement tube assembly mainly in chord-wise direction in direction of the trailing edge. In the latter case, the cooling medium may then cool a trailing pedestal cooling region and eventually it will be exhausted via a slot or openings at the trailing edge of the aerofoil. Thus, the impingement tube assembly comprising the impingement tube and the corresponding sleeve perform the same functionality as a sole impingement tube in a prior art design.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the embodiments, the invention is not limited by the examples disclosed, and other variations can be derived therefrom by a person skilled in the art without departing from the scope of the invention.

The invention claimed is:

1. A turbine assembly, comprising:

a basically hollow aerofoil, an impingement tube, and an impingement tube sleeve, the impingement tube sleeve comprising at least one impingement tube sleeve segment, the hollow aerofoil having at its interior surface longitudinal ribs extending from a leading edge towards a trailing edge of the hollow aerofoil, wherein a first impingement tube sleeve segment of the at least one impingement tube sleeve segment provides a slotted flow blocker at a surface of the first impingement tube sleeve segment, the first impingement tube sleeve segment being inserted into the hollow aerofoil such that the ribs of the hollow aerofoil engage with corresponding slots of the slotted flow blocker and such that the surface of the first impingement tube sleeve segment rests on the ribs, wherein the impingement tube is inserted into the hollow aerofoil such that the at least one impingement tube sleeve segment is arranged between the interior surface of the hollow aerofoil and an exterior surface of the impingement tube.

2. The turbine assembly according to claim 1, wherein a plurality of impingement cooling cavities are formed between the interior surface of the hollow aerofoil and surfaces of the at least one impingement tube sleeve segment, each separated by one of the ribs.

3. The turbine assembly according to claim 1, wherein a second impingement tube sleeve segment of the at least one impingement tube sleeve segment provides a slotted flow blocker at a surface of the second impingement tube sleeve segment, the second impingement tube sleeve segment being inserted into the hollow aerofoil such that the ribs of the hollow aerofoil engage with corresponding slots of the slotted flow blocker and such that the surface of the second impingement tube sleeve segment rests on the ribs, wherein the slotted flow blocker of the first impingement tube sleeve segment and the slotted flow blocker of the second impingement tube sleeve segment define impingement cooling cavities for a leading edge of the aerofoil which are separated by the flow blockers from remaining impingement cooling cavities.

4. The turbine assembly according to claim 1, wherein the at least one impingement tube sleeve segment and the impingement tube are joined via a form-fit connection.

5. The turbine assembly according to claim 1, wherein the first impingement tube sleeve segment comprises cut-outs wherein impingement cooling holes of the impingement tube are positioned in alignment of the cut-outs.

6. The turbine assembly according to claim 1, wherein the slotted flow blocker is arranged as a slotted ridge attached to or being part of the first impingement tube sleeve segment, or as folded sheet metal cut-outs of the first impingement tube sleeve segment.

7. The turbine assembly according to claim 1, wherein the slotted flow blocker is arranged as broken seal elements attached to the first impingement tube sleeve segment, or configured as rope seal elements.

8. The turbine assembly according to claim 1, wherein the slotted flow blocker extends substantially in span-wise direction of the first impingement tube sleeve segment.

9. The turbine assembly according to claim 1, wherein the hollow aerofoil, the impingement tube and the impingement tube sleeve are separate components joined together for the turbine assembly, and/or wherein the impingement tube and the impingement tube sleeve comprise sheet metal inserts for the hollow aerofoil.

10. The turbine assembly according to claim 1, wherein the hollow aerofoil is a turbine blade or a turbine vane, or a gas turbine blade or a gas turbine vane.

11. A method for assembling a turbine assembly according to claim 1, wherein the method comprises:

providing the basically hollow aerofoil;

inserting the first impingement tube sleeve segment into a central region of the hollow aerofoil;

manoeuvring the inserted first impingement tube sleeve segment into position in a direction of a corresponding wall section of the hollow aerofoil such that the ribs of the hollow aerofoil engage with corresponding slots of the slotted flow blocker of the first impingement tube sleeve segment and such that the surface of the first impingement tube sleeve segment rests on the ribs of the hollow aerofoil;

optionally inserting and manoeuvring at least one further one of the at least one impingement tube sleeve segment such that a further surface of the at least one further one of the at least one impingement tube sleeve segment rests on the ribs of the hollow aerofoil;

inserting the impingement tube into the hollow aerofoil such that the at least one impingement tube sleeve segment is arranged between the interior surface of the hollow aerofoil and an exterior surface of the impingement tube.

12. The method for assembling a turbine assembly according to claim 11, wherein inserting first impingement tube sleeve segment into a central region of the hollow aerofoil and inserting the impingement tube into the hollow aerofoil are performed by bringing the respective component into the hollow aerofoil via an aperture from a span-wise direction.

* * * * *